US011578722B2

(12) United States Patent
Turner et al.

(10) Patent No.: US 11,578,722 B2
(45) Date of Patent: Feb. 14, 2023

(54) MULTI-STAGE VACUUM BOOSTER PUMP COUPLING

(71) Applicant: Edwards Limited, Burgess Hill (GB)

(72) Inventors: Neil Turner, Godalming (GB); David Alan Turrell, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 39 days.

(21) Appl. No.: 16/478,367

(22) PCT Filed: Jan. 19, 2018

(86) PCT No.: PCT/GB2018/050159
§ 371 (c)(1),
(2) Date: Jul. 16, 2019

(87) PCT Pub. No.: WO2018/134610
PCT Pub. Date: Jul. 26, 2018

(65) Prior Publication Data

US 2019/0360487 A1 Nov. 28, 2019

(30) Foreign Application Priority Data

Jan. 20, 2017 (GB) ..... 1701000

(51) Int. Cl.
*F04C 18/12* (2006.01)
*F04C 23/00* (2006.01)
(Continued)

(52) U.S. Cl.
CPC ..... *F04C 18/126* (2013.01); *F04C 23/001* (2013.01); *F04C 25/02* (2013.01);
(Continued)

(58) Field of Classification Search
CPC ..... F04C 14/24; F04C 18/126; F04C 23/001; F04C 25/02; F04C 28/26; F04C 2220/10; F04C 2240/30
(Continued)

(56) References Cited

U.S. PATENT DOCUMENTS 3,198,120 A 8/1965 Little, Jr.
3,667,874 A 6/1972 Weatherston et al.
(Continued)

FOREIGN PATENT DOCUMENTS

AT 177505 B 2/1954
CN 2660175 Y 12/2004
(Continued)

OTHER PUBLICATIONS

Translation of the Notification of First Office Action from counterpart Chinese Application No. 201880007725.X, dated Mar. 5, 2020, 15 pp.
(Continued)

*Primary Examiner* — Philip E Stimpert
(74) *Attorney, Agent, or Firm* — Shumaker & Sieffert, P.A.

(57) ABSTRACT

An inter-stage coupling for a multi-stage vacuum booster pump may include a first coupling face configured to be received by a first adjacent stage of the multi-stage vacuum pump; a second coupling face configured to be received by a second adjacent stage of the multi-stage vacuum pump; and a recirculator comprising a recirculation inlet aperture formed in the first coupling face, a recirculation outlet aperture formed in the first coupling face, and a recirculation conduit having a recirculation valve configured to selectively fluidly couple the recirculation inlet aperture with the recirculation outlet aperture. In this way, the pressure in a stage can be relieved by fluidly coupling the outlet aperture
(Continued)

with the inlet aperture in order to recirculate built-up gas from one part of the first stage pump to another part of the first stage pump in order to reduce the strain on the rotor.

13 Claims, 4 Drawing Sheets

(51) Int. Cl.
*F04C 25/02* (2006.01)
*F04C 28/26* (2006.01)

(52) U.S. Cl.
CPC ..... *F04C 28/26* (2013.01); *F04C 2220/10* (2013.01); *F04C 2240/30* (2013.01)

(58) Field of Classification Search
USPC ..... 417/440
See application file for complete search history.

(56) References Cited

U.S. PATENT DOCUMENTS

| | | | | |
|---|---|---|---|---|
| 4,328,824 | A | 5/1982 | Kiernan et al. | |
| 5,040,949 | A | 8/1991 | Crinquette et al. | |
| 5,049,050 | A | 9/1991 | Berges et al. | |
| 6,123,526 | A | 9/2000 | Chen et al. | |
| 8,662,869 | B2 | 3/2014 | Suzuki et al. | |
| 8,740,578 | B2 | 6/2014 | Kamecke et al. | |
| 9,388,809 | B2 | 7/2016 | Denny | |
| 2004/0126255 | A1 | 7/2004 | Kuramoto et al. | |
| 2004/0247465 | A1 | 12/2004 | Koshimura | |
| 2005/0089424 | A1 | 4/2005 | Liu et al. | |
| 2010/0150760 | A1 | 6/2010 | Yamamoto et al. | |
| 2011/0129374 | A1* | 6/2011 | Kamecke | F04C 18/126 417/440 |
| 2013/0280062 | A1* | 10/2013 | Suzuki | F04C 11/001 415/213.1 |
| 2014/0099225 | A1* | 4/2014 | Denny | F04C 13/008 418/1 |

FOREIGN PATENT DOCUMENTS

| | | | | | |
|---|---|---|---|---|---|
| CN | 101418804 | A | | 4/2009 | |
| CN | 201396281 | Y | | 2/2010 | |
| CN | 103104491 | A | | 5/2013 | |
| EP | 1020645 | A1 | | 7/2000 | |
| EP | 1536140 | A1 | | 6/2005 | |
| JP | S52-21410 | | | 2/1977 | |
| JP | S5221410 | | * | 2/1977 | |
| JP | H0333492 | A | | 2/1991 | |
| JP | 2000345981 | A | | 12/2000 | |
| JP | 2007218195 | A | | 8/2007 | |
| JP | 2011202603 | A | * | 10/2011 | F04C 28/26 |
| JP | 2011202603 | A | | 10/2011 | |
| JP | 2011528765 | A | | 11/2011 | |
| KR | 20140033443 | A | | 3/2014 | |
| TW | 200936885 | A | | 9/2009 | |
| TW | 201014978 | A | | 4/2010 | |
| WO | 2010009939 | A1 | | 1/2010 | |
| WO | 20120093393 | A1 | | 7/2012 | |
| WO | 2016/093499 | A1 | | 6/2016 | |

OTHER PUBLICATIONS

Combined Search and Examination Report under Sections 17 and 18 (3) dated Jun. 23, 2017 in counterpart GB Application No. 1701000.0, 5 pp.
International Search Report and the Written Opinion of the International Searching Authority dated Mar. 22, 2018 in counterpart International Application No. PCT/GB2018/050159, 10 pp.
Translation of the Office Action from counterpart Taiwanese Application No. 107102256, dated Feb. 25, 2021, 3 pp.
Office Action from U.S. Appl. No. 16/478,357, dated May 17, 2021, 10 pp.
Final Office Action from U.S. Appl. No. 16/478,357, dated Jan. 13, 2022, 9 pp.
Translation of the Office Action from counterpart Japanese Application No. 2019-538621, dated Oct. 11, 2021, 5 pp.
Response to Office Action filed Nov. 17, 2021 in U.S. Appl. No. 16/478,357, 7 pp.
Office Action and translation thereof, from counterpart Korean Application No. 2019-7021317 dated Jun. 23, 2022, 9 pp.

* cited by examiner

MULTI-STAGE VACUUM BOOSTER PUMP COUPLING

This application is a national stage entry under 35 U.S.C. § 371 of International Application No. PCT/GB2018/050159, filed Jan. 19, 2018, which claims the benefit of GB Application 1701000.0, filed Jan. 20, 2017. The entire contents of International Application No. PCT/GB2018/050159 and GB Application 1701000.0 are incorporated herein by reference.

TECHNICAL FIELD

The present disclosure relates to an inter-stage coupling for a multi-stage vacuum booster pump, a vacuum pump and a method.

BACKGROUND

Vacuum pumps are known. These pumps are typically employed as a component of a vacuum system to evacuate devices. Also, these pumps are used to evacuate fabrication equipment used in, for example, the production of semiconductors. Rather than performing compression from a vacuum to atmosphere in a single stage using a single pump, it is known to provide multistage vacuum pumps where each stage performs a portion of the complete compression range required to transition from a vacuum to atmospheric pressure.

Although such multi-stage vacuum pumps provide advantages, they also have their own shortcomings. Accordingly, it is desired to provide an improved arrangement for multi-stage vacuum pumps.

SUMMARY

According to a first aspect, there is provided an inter-stage coupling for a multistage vacuum pump, comprising: a first coupling face configured to be received by a first adjacent stage of the multi-stage vacuum pump; a second coupling face configured to be received by a second adjacent stage of the multi-stage vacuum pump; and a recirculator comprising a recirculation inlet aperture formed in the first coupling face, a recirculation outlet aperture formed in the first coupling face, and a recirculation conduit having a recirculation valve configured to selectively fluidly couple the recirculation inlet aperture with the recirculation outlet aperture. The first aspect recognizes that a problem with multi-stage vacuum pumps is that gas can build up on the exhaust side of a stage, which causes stress on its rotor. The gas can build because more gas is exhausted by the stage than a subsequent stage can handle, for example when the pump inlet is vented.

Accordingly, an inter-stage coupling is provided. The inter-stage coupling may be for a multi-stage pump. The pump may be a vacuum pump. The coupling may comprise a first coupling face. The first coupling face may be configured, arranged or dimensioned to receive, join or connect with an adjacent stage of the pump to define, close or seal that adjacent stage. The coupling may comprise a second coupling face. The second coupling face may be configured, arranged or dimensioned to receive, join or connect with another adjacent stage of the pump to define, close or seal that adjacent stage. The inter-stage coupling may be provided to couple stages having separate stator housings or may be used to partition a single stator housing into separate stages. The coupling may also comprise a recirculator. The recirculator may define a recirculation inlet aperture or opening which is formed or provided in the first coupling face. The recirculator may also define a recirculation outlet aperture which is also formed or provided in the first coupling face. The recirculator may also comprise a recirculation conduit which has a recirculation valve. The recirculation conduit and recirculation valve may be configured or arranged to selectively couple the recirculation inlet aperture with the recirculation outlet aperture. In this way, the pressure in a stage can be relieved by fluidly coupling the outlet aperture with the inlet aperture in order to recirculate built-up gas from one part of the first stage pump to another part of the first stage pump in order to reduce the strain on the rotor.

In one embodiment, the recirculator is housed within the inter-stage coupling between the first coupling face and the second coupling face. Accordingly, the recirculator may be positioned within the inter-stage coupling itself, which provides for a particularly compact and self-contained arrangement and minimizes the complexity of the multi-stage pump. Also, providing the recirculator between stages insulates the recirculator from the cooler ambient conditions surrounding the pump and, in applications where solid material is likely to condense from the pumped medium, the risk of condensation is reduced by the elevated temperature in the recirculator, thereby reducing the risk that it becomes immobilized and ineffective. In one embodiment, at least a portion of each of the first and second coupling faces is configured as a plate to seal an end of the respective adjacent stage of the multi-stage vacuum pump. Accordingly, the coupling faces may seal the adjacent stages, thereby acting as part of their housing.

In one embodiment, the recirculation inlet aperture is located for fluid communication with an exhaust of the first adjacent stage and the recirculation outlet aperture is located for fluid communication with an inlet of the first adjacent stage. Hence, the recirculator may receive the exhaust of the first adjacent stage and may recirculate the exhaust, or at least a part of it, to the inlet of the first adjacent stage via the valve in order to reduce the pressure imbalance across the rotor. In one embodiment, the first coupling face defines an inlet aperture to receive an exhaust from the first adjacent stage and the second coupling face defines an outlet aperture to deliver the exhaust to the second adjacent stage, the interstage coupling defining a transfer conduit configured to fluidly couple the inlet aperture with the outlet aperture. Accordingly, the inter-stage coupling may also be used to transfer gas from the first adjacent stage to the second adjacent stage.

In one embodiment, the inlet aperture is located fluidly downstream of the first adjacent stage and the outlet aperture is located fluidly upstream of the second adjacent stage. Accordingly, the exhaust of the first adjacent stage may be provided from the inlet aperture and delivered via the outlet aperture to an inlet of the second adjacent stage.

In one embodiment, the inlet aperture comprises the inlet recirculation aperture and the transfer conduit shares at least a portion of the recirculation conduit. Accordingly, the complexity of the coupling may be reduced by sharing the inlet aperture and the inlet recirculation aperture and/or by sharing the transfer conduit and the recirculation conduit.

In one embodiment, the recirculation valve comprises a pressure-actuated valve actuatable to couple the recirculation inlet aperture with the recirculation outlet aperture in response to a selected pressure differential between the recirculation inlet aperture and the recirculation outlet aperture. Accordingly, the recirculation valve may couple the recirculation inlet aperture with the recirculation outlet aperture under a selected or predetermined pressure differential between the two. In other words, the recirculation valve may have a decoupled position where the recirculation inlet aperture and the recirculation outlet aperture are fluidly decoupled under less than the selected pressure differential. The recirculation inlet aperture and the recirculation outlet aperture may then be fluidly coupled when the pressure differential is greater than the selected or predetermined pressure differential.

In one embodiment, the recirculation valve comprises a moveable member, displaceable to couple the recirculation inlet aperture with the recirculation outlet aperture in response to a selected pressure differential between the recirculation inlet aperture and the recirculation outlet aperture. The recirculation valve may be configured so that the member is displaced by a translation movement. In this embodiment, the moveable member may be a piston. The recirculation valve may be configured so that the member is displaced by a rotational or angular movement. In this embodiment, the moveable member may be a pivoting flap. Accordingly, a piston, flap or movable member may be provided which displaces or moves from a position which closes or blocks the recirculation conduit to a position which opens or unblocks the recirculation conduit.

In one embodiment, the moveable member is one of biased and weighted in a decoupled position and displaceable to a coupled position in response to a selected pressure differential between the recirculation inlet aperture and the recirculation outlet aperture. Accordingly, the piston, flap or moveable member may either be biased or weighted into the decoupled position. The piston, flap or moveable member may be displaceable to the coupled position in response to a selected pressure differential between the recirculation inlet aperture and the recirculation outlet aperture.

In one embodiment, the inter-stage coupling comprises a second recirculator comprising a second recirculation inlet aperture formed in the second coupling face, a second recirculation outlet aperture formed in the second coupling face, and a second recirculation conduit having a second recirculation valve configured to selectively fluidly couple the second recirculation inlet aperture with the second recirculation outlet aperture. Accordingly, a further recirculator may be provided within the coupling to provide for gas recirculation within the second adjacent stage. According to a second aspect, there is provided a multi-stage vacuum pump, comprising: a first pumping stage; a second pumping stage; and an inter-stage coupling of the first aspect coupling the first pumping stage with the second pumping stage. According to a third aspect, there is provided a method, comprising: providing a first coupling face configured to be received by a first adjacent stage of the multistage vacuum pump; providing a second coupling face configured to be received by a second adjacent stage of the multi-stage vacuum pump; and providing a recirculator comprising a recirculation inlet aperture formed in the first coupling face, a recirculation outlet aperture formed in the first coupling face, and a recirculation conduit having a recirculation valve configured to selectively fluidly couple the recirculation inlet aperture with the recirculation outlet aperture.

In one embodiment, the method comprises housing the recirculator within the inter-stage coupling between the first coupling face and the second coupling face. In one embodiment, the method comprises configuring at least a portion of each of the first and second coupling faces as a plate to seal an end of the respective adjacent stage of the multi-stage vacuum pump. In one embodiment, the method comprises locating the recirculation inlet aperture for fluid communication with an exhaust of the first adjacent stage and locating the recirculation outlet aperture for fluid communication with an inlet of the first adjacent stage. In one embodiment, the method comprises defining an inlet aperture in the first coupling face to receive an exhaust from the first adjacent stage, defining an outlet aperture in the second coupling face to deliver the exhaust to the second adjacent stage and defining a transfer conduit configured to fluidly couple the inlet aperture with the outlet aperture.

In one embodiment, the method comprises locating the inlet aperture is fluidly downstream of the first adjacent stage and locating the outlet aperture is fluidly upstream of the second adjacent stage. In one embodiment, the inlet aperture comprises the inlet recirculation aperture and the transfer conduit shares at least a portion of the recirculation conduit.

In one embodiment, the recirculation valve comprises a pressure-actuated valve and the method comprises coupling the recirculation inlet aperture with the recirculation outlet aperture in response to a selected pressure differential between the recirculation inlet aperture and the recirculation outlet aperture.

In one embodiment, the recirculation valve comprises a displaceable member and the method comprises coupling the recirculation inlet aperture with the recirculation outlet aperture in response to a selected pressure differential between the recirculation inlet aperture and the recirculation outlet aperture. In one embodiment, the method comprises the member being one of biased and weighted in a decoupled position and displaceable to a coupled position in response to a selected pressure differential between the recirculation inlet aperture and the recirculation outlet aperture.

In one embodiment, the method comprises providing a second recirculator comprising a second recirculation inlet aperture formed in the second coupling face, a second recirculation outlet aperture formed in the second coupling face, and a second recirculation conduit having a second recirculation valve configured to selectively fluidly couple the second recirculation inlet aperture with the second recirculation outlet aperture.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

BRIEF DESCRIPTION OF THE DRAWINGS

Embodiments of the present disclosure will now be described further, with reference to the accompanying drawings.

DETAILED DESCRIPTION

Before discussing the embodiments in any more detail, first an overview will be provided. Embodiments provide a coupling for a multi-stage pump. The coupling may be used to couple adjacent stages together. The coupling helps to prevent damage occurring within an adjacent stage by preventing greater than a damaging pressure differential occurring within that stage. When a potentially damaging pressure differential occurs, a recirculation valve in the coupling operates to couple an exhaust side of the adjacent pump with its inlet side and recirculate gas from the exhaust to the inlet, in order to avoid that pressure differential, which may cause damage to the rotor or the pump. Additional recirculators may be provided for each adjacent stage pump, each provided within the housing of the inter-stage coupling. In order to simplify the coupling and provide a compact arrangement, the recirculator may share apertures and conduits provided to transfer gas between adjacent stages.

Two-Stage Pump

Figure 1A:
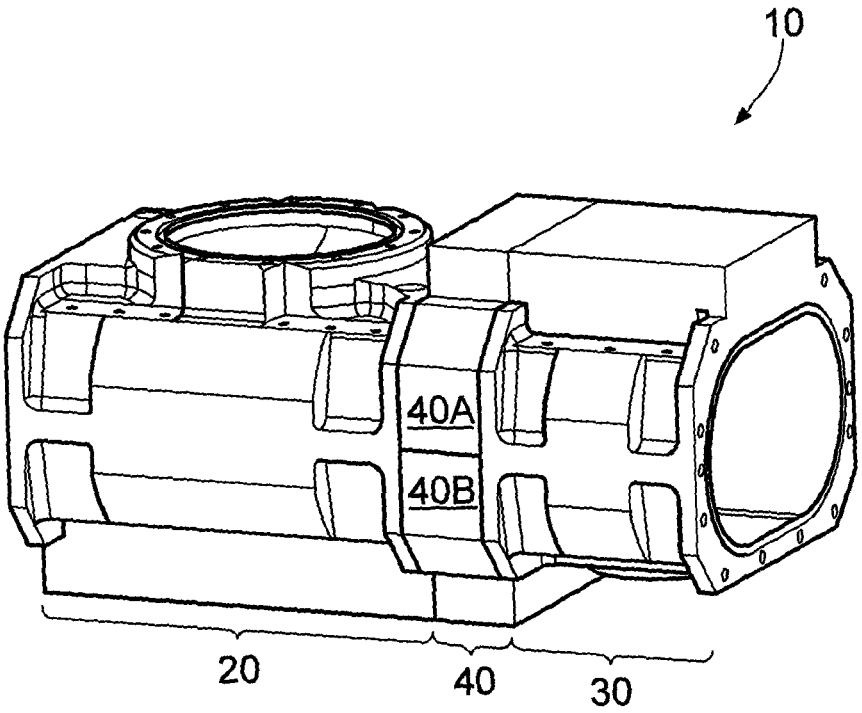
FIGS. 1A and 1B illustrate a two-stage booster pump according to one embodiment.
Figure 1B:
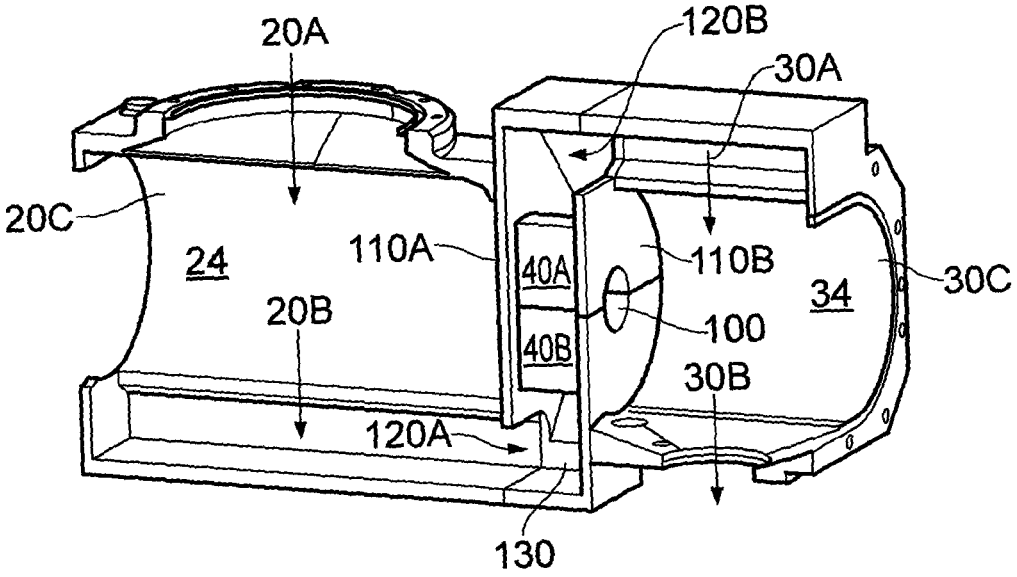

FIGS. 1A and 1B illustrate a two-stage booster pump, generally 10, according to one embodiment. A first pumping stage 20 is coupled with a second pumping stage 30 via an inter-stage coupling unit 40. The first pumping stage 20 has a first stage inlet 20A and a first stage exhaust 20B. The second pumping stage 30 has a second stage inlet 30A and a second stage exhaust 30B.

Coupling

The inter-stage coupling 40 is formed from a first portion 40A and a second portion 40B. The first portion 40A is releasably fixable to the second portion 40B. When brought together, the first and second portions 40A, 40B define a gallery 130 within the interstage coupling unit through which gas may pass during operation of the pump. The inter-stage coupling unit 40 defines a cylindrical void 100 which extends through the width of the inter-stage coupling unit 40. The first portion 40A forms a first portion of the void 100 and the second portion 40B forms a second portion of the void 100. The void 100 separates to receive a one piece rotor 50, as will now be described in more detail.

Rotor

Figure 2:
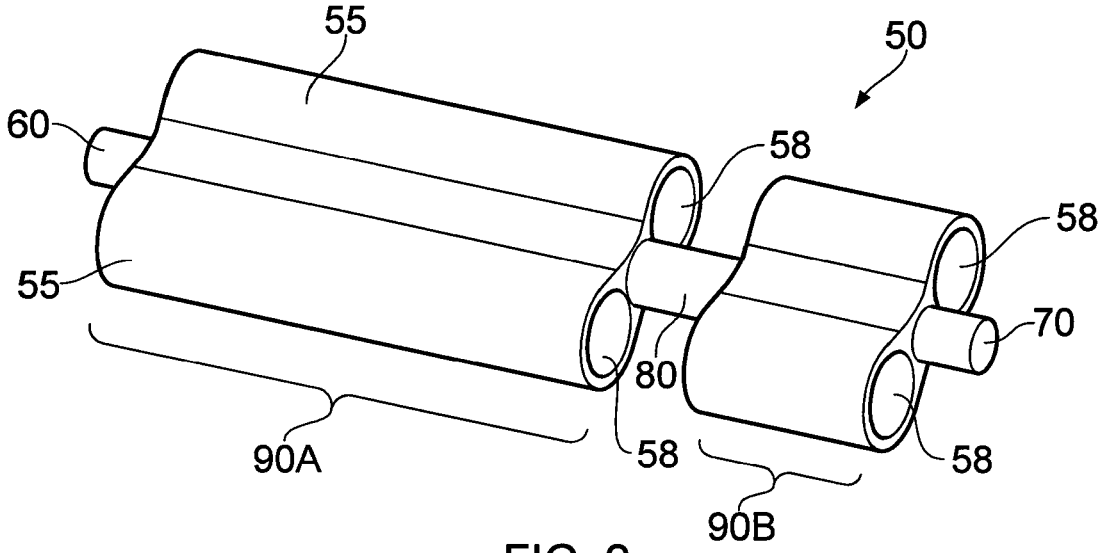
FIG. 2 is a perspective view of a rotor used in the two-stage booster pump of FIGS. 1A and 1B.

FIG. 2 is a perspective view of the rotor 50. The rotor 50 is a rotor of the type used in a positive displacement lobe pump which utilizes meshing pairs of lobes. Each rotor has a pair of lobes formed symmetrically about a rotatable shaft.

Each lobe 55 is defined by alternating tangential sections of curves. The curves can be of any suitable form such as circular arcs, or hypocycloidal and epicycloidal curves, or a combination of these, as is known. In this example, the rotor 50 is unitary, machined from a single metal element and cylindrical voids 58 extend axially through the lobes 55 to reduce mass.

A first axial end 60 of the shaft is received within a bearing provided by a head plate (not shown) of the first pumping stage 20 and extends from a first rotary vane portion 90A which is received within a stator of the first stage 20. An intermediate axial portion 80 extends from the first rotary vane portion 90A and is received within the void 100. The void 100 provides a close fit on the surface of the intermediate axial portion 80, but does not act as a bearing. A second rotary vane portion 90B extends axially from the intermediate axial portion 80 and is received within a stator of the second stage 30. A second axial end 70 extends axially from the second rotary vane portion 90B. The second axial end 70 is received by a bearing in a head plate (not shown) of the second pumping stage 30. The rotor 50 is machined as a single part, with cutters forming the surface of the pair of lobes 55. The axial portions 60, 70, 80 are boing turned to form the first rotary vane portion 90A and the second rotary vane portion 90B.

As will be understood, a second rotor 50 (not shown) is received within a second void 100 which also extends through the width of the inter-stage coupling 40 but is laterally spaced from the first void 100. The second rotor 50 is identical to the aforementioned rotor 50 and is rotationally offset by 90" thereto so that the two rotors 50, mesh in synchronism.

Pump Stage Stators

Returning to FIG. 1A, the first pumping stage pump 20 comprises a unitary stator 22, forming a chamber 24 therewithin. The chamber 24 being sealed at one end by the head plate (not shown) and at the other end by the inter-stage coupling unit 40. The unitary stator 22 has a first inner surface 20C. In this embodiment, the first inner surface 20C is defined by equal semi-circular portions coupled to straight sections which extend tangentially between the semi-circular portions to define a void/chamber 24 which receives the rotors 50.

However, embodiments may also define a generally-figure-of-eight cross-section void. The second pumping stage 30 comprises a unitary stator 32 forming chamber 34 therewithin. The chamber 34 being sealed at one end by the head plate (not shown) and at the other end by the inter-stage coupling unit 40. The unitary stator 32 has a second inner surface 30C defining a slightly figure-of-eight cross-sectional chamber 34 which receives the rotors 50. The presence of the unitary stators 22, 32 greatly increases the mechanical integrity and reduces the complexity of the first pumping stage 20 and the second pumping stage 30. In an alternative embodiment, the head plate could also be integrated into each stator unit 22, 32 to form a bucket type arrangement, such an approach would further reduce the number of components present. The first rotary vane portions 90A of the rotors 50, mesh in operation and follow the first inner surface 20C to compress gas provided from an upstream device or apparatus at a first stage inlet 20A and provide the compressed gas at a first stage exhaust 20B. The compressed gas provided at the first stage exhaust 20B passes through an inlet aperture 120A formed in a first face 110A of the inter-stage coupling unit 40. The first face 110A represents a boundary between the first pumping stage 20 and the gallery 130. The compressed gas travels through a gallery 130 formed within the inter-stage coupling unit 40 and exits through an outlet aperture 120B in a second face 110B of the inter-stage coupling unit 40. The second face 110B represents a boundary between the gallery 130 and the second pumping stage 30. The compressed gas exiting the outlet aperture 120B is received at a second stage inlet 30A. The compressed gas received at the second stage inlet 30A is further compressed by the second rotary vane portions 90B of the rotors 50 as they mesh and follow the second inner surface 30C and the gas exits via a second stage exhaust 30B.

Assembly

The assembly of the two-stage booster pump 10 is typically performed on a turnover fixture. The unitary stator 22 of the first pumping stage pump 20 is secured to the build fixture. The head plate is attached to the stator 22 and then the assembly rotated through 180 degrees.

The two rotors 50 are lowered into the first stage stator 22. The first portion 40A and the second portion 40B of the inter-stage coupling 40 are slid together over the intermediate axial portion 80 to retain first rotary vane portion 90A within the first pumping stage 20. The first portion 40A and the second portion 40B of the inter-stage coupling unit 40 are then typically doweled and bolted together. The assembled halves of the inter-stage coupling 40 are then attached to the unitary stator 22 of the first pumping stage 20.

The unitary stator 32 of the second pumping stage 30 is now carefully lowered over the second rotary vane portion 90B and attached to the inter-stage coupling unit 40.

A head plate is now attached to the unitary stator 32 of the second stage pump 30. The two rotors 50, are retained by bearings in the two head plates.

Recirculation Valve

Figure 3:
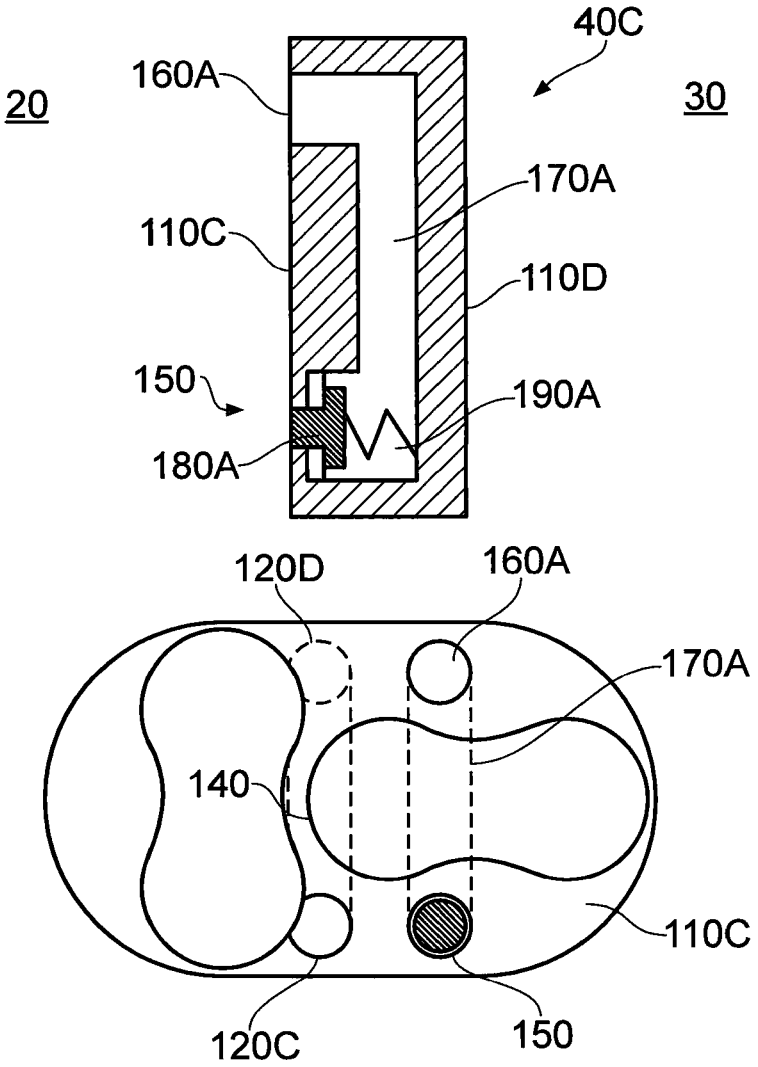
FIG. 3 illustrates the arrangement of an inter-stage coupling with a recirculator according to one embodiment.

FIG. 3 illustrates the arrangement of an inter-stage coupling, generally 40C, according to one embodiment. In this embodiment, the inter-stage coupling 40C is formed from a unitary housing. However, it will be appreciated that split housing arrangements similar to those mentioned above can equally be provided.

The inter-stage coupling 40C sits between the first pumping stage 20 and the second pumping stage 30. The inter-stage coupling 40C has a first face 110C which receives the first pumping stage 20 and an opposing second face 110D which receives the second pumping stage 30. An inlet aperture 120C (or a plurality of apertures) is formed in the first face 110C and couples via a transfer conduit 140 to an outlet aperture 120D (or a plurality of apertures) in the opposing second face 110D. A recirculation inlet aperture 150 (or a plurality of apertures) is also provided in the first face 110C and couples via a recirculation conduit 170A with a recirculation outlet aperture 160A also provided on the first face 110C.

A displaceable valve member 180A is biased by a spring 190A into a closed position where the valve member 180A closes the recirculation inlet aperture 150 to prevent the transfer of gas from the recirculation inlet aperture 150 to the recirculation outlet aperture 160A. When the difference in pressure of the gas between the recirculation inlet aperture 150 and the recirculation outlet aperture 160A is sufficient to overcome the bias of the spring 190A, the valve member 180A displaces axially towards the second pumping stage 30 and fluidly couples the recirculation inlet aperture 150 with the recirculation outlet aperture 160A. Gas then flows from the recirculation inlet aperture 150 via the recirculation conduit 170A and out of the recirculation outlet aperture 160A to reduce the pressure differential within the first pumping stage 20.

Figure 4:
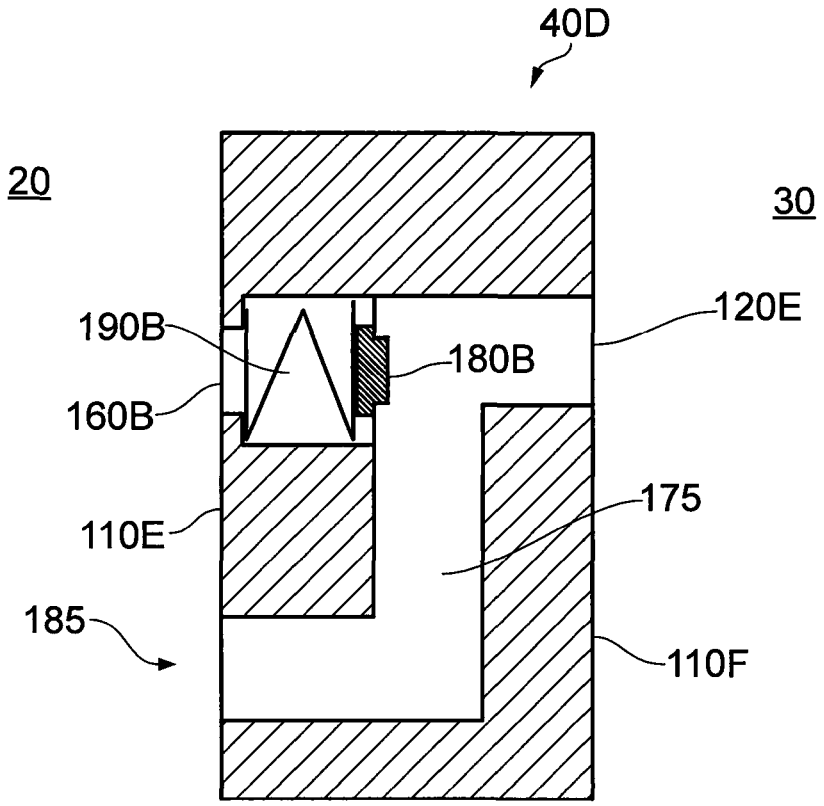
FIG. 4 illustrates the arrangement of an inter-stage coupling with a recirculator, according to one embodiment.

FIG. 4 shows an inter-stage coupling 40D with a similar arrangement to that of FIG. 3, but a shared conduit 175 is provided which couples a shared inlet 185 (provided in a first face 110E) with a recirculation outlet aperture 160B (or a plurality of apertures also provided in the first face 110E) and an outlet aperture 120E (or a plurality of apertures provided in a second face 110F). A valve member 180B is provided which is biased by a spring 190B to seal the recirculation outlet aperture 160B from the shared conduit 175. The shared conduit is also used to transfer gas between adjacent stages, from the shared inlet 185 to outlet aperture 120E.

When the pressure difference between the shared inlet 185 and the recirculation outlet aperture 160B is sufficient to overcome the biasing force of the spring 190B and displace the valve member 180B axially in the direction of the first pumping stage 20, gas can flow from the shared inlet 185 via the shared conduit 175 to the recirculation outlet aperture 160B in order to reduce the pressure differential within the first pumping stage 20.

Figure 5:
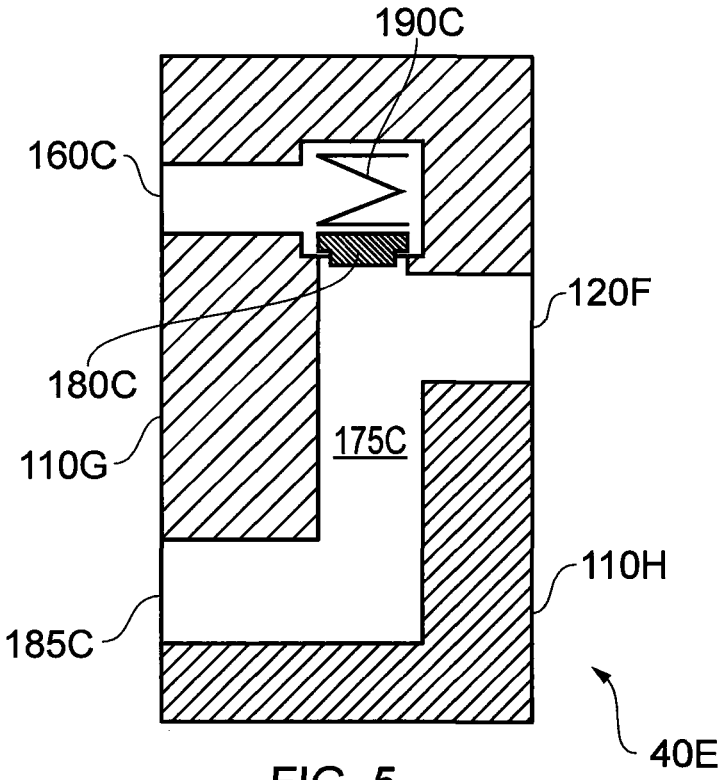
FIG. 5 illustrates the arrangement of an inter-stage coupling with a recirculator, according to one embodiment.

It will be appreciated that a variety of different valve arrangements are possible. In particular, one embodiment of an inter stage coupling unit 40E, as illustrated in FIG. 5, envisages a valve member 180C which is weighted and orientated to displace vertically within the recirculation conduit 175C. In that arrangement, the weight of the valve (either alone or assisted with a vertically biased spring 190C) retains the valve in a closed position, but is displaced by a pressure differential between the shared inlet 185C and the recirculation outlet aperture 160C. A similar, vertically displaceable member could be implemented in an arrangement of the type shown in FIG. 3.

Figure 6:
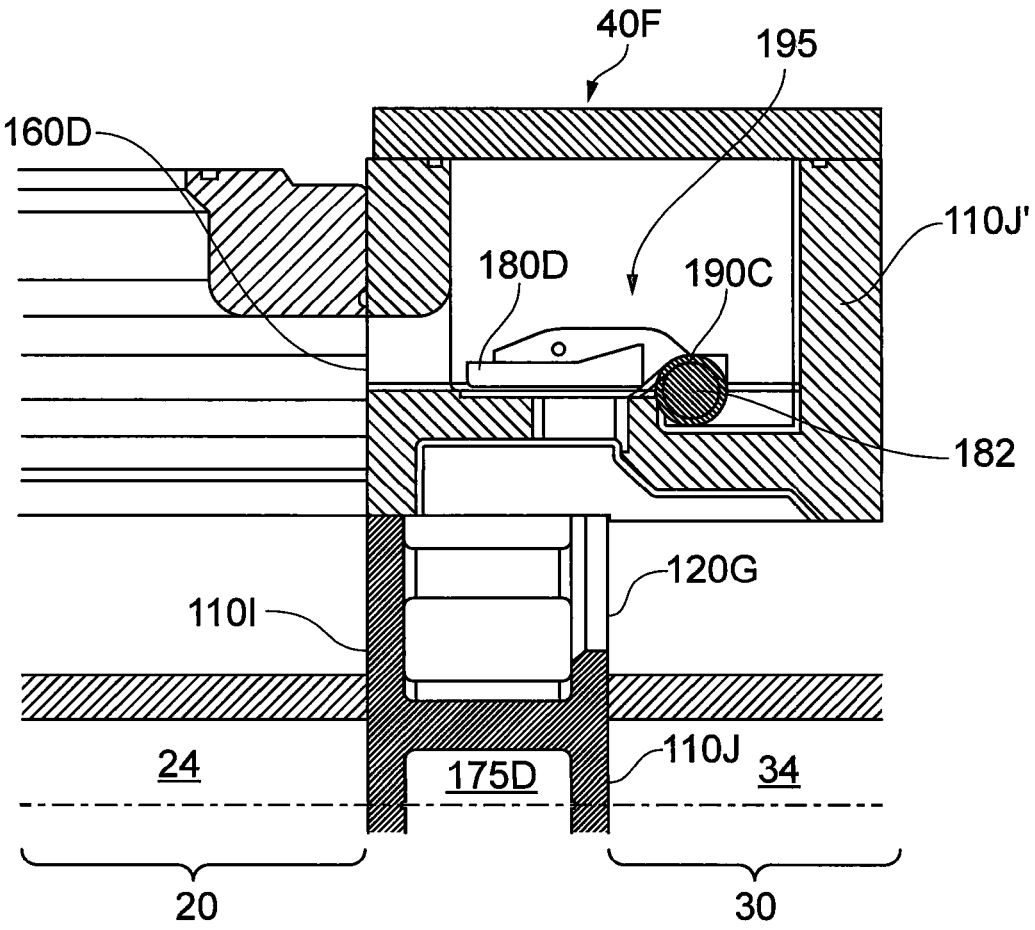
FIG. 6 illustrates the arrangement of an inter-stage coupling with a recirculator comprising a flap arrangement.
Figure 7:
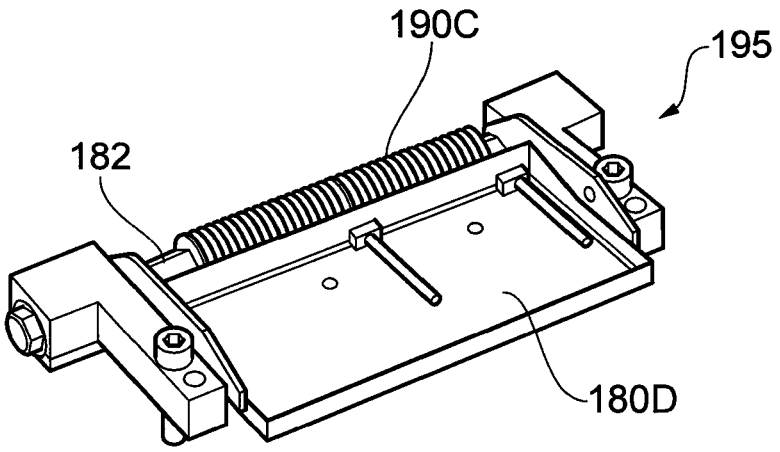
FIG. 7 illustrates the flap arrangement of FIG. 6 in more detail.

In the embodiments illustrated in FIGS. 3-5, the valve member is represented by a piston arrangement. The valve member 180A, 180B, 180C being displaceable in a translational sense. In an alternative embodiment, as illustrated in FIGS. 6 and 7, the valve member is provided by a flap arrangement comprising a flap 180D, connected to a surface of the shared conduit 175D by a hinge 182. A spring 190C is provided about the hinge 182 to bias the flap 180D into a closed position. In the arrangement shown in FIG. 6, inter-stage coupling unit 40F is located between the first pumping stage 20 and the second pumping stage 30. As in FIG. 4 the gallery 130 represents a shared conduit 175D. This shared conduit 175D couples a shared inlet 185D, in a first face 1101, with one or more recirculation outlet apertures 160D and with one or more outlet apertures 120G in a second face 110J.

The first face 1101 clearly represents a boundary between the first pumping stage 20 and the inter stage coupling 40F. The second face 110J, together with an extension 110J' to the second face 110J, clearly represents a boundary between the inter stage coupling unit 40F and the second stage 30. The shared conduit 175D is defined by the region between these two boundaries. The flap arrangement is located within the shared conduit 175D. It is positioned in the flow path between the outlet aperture 120G and the recirculation outlet aperture 160D. In order to accommodate the bulk of the hinge 182 and spring 190C of the flap mechanism, the flap arrangement has been positioned radially outside the extent of the pumping chambers 24, 34.

The flap 180D is configured to pivot about the hinge 182 between a first, closed position as illustrated and a second, open position (not shown). The flap 1 80D is biased towards the first closed position by spring 190C.

Although inter-stage coupling 40C, 40D, 40E, 40F mentioned above are used to join two stators of adjacent stages, in one embodiment an inter-stage coupling having a recirculation valve is provided which fits within a single stator body, the inter-stage coupling separating adjacent stages within that single stator body.

Accordingly, it can be seen that embodiments provide a coupling which couples stages of a multi-stage vacuum pump. That is to say, the coupling sits between stages of a multi-stage vacuum pump. The multi-stage vacuum pump may have any number of stages and one or more couplings may sit between any adjacent two of those stages which need not be the first and second stages of the pump. The coupling unit has an opposing pair of outwardly-facing coupling faces which attach to adjacent stages. The coupling has an internal arrangement which couples an inlet formed in one coupling face with an outlet formed in that coupling face. The arrangement has a valve which selectively couples the inlet with the outlet in response to a pressure differential between the two. This coupling recirculates excess gas from an exhaust of the adjacent stage back to the inlet of that stage, in order to reduce strain on that stage of the pump, should a so-called "gas dump" occur where excess gas is introduced into the exhaust of that stage, such as may occur when venting the pump. Embodiments envisage a variety of different pressure actuated valve arrangements. Some embodiments also re-use an existing inter-stage transfer conduit to provide a portion of the recirculator.

Embodiments provide a relief valve incorporated into a pump interstage, which is particularly suitable for clam-shell type pump assembly methods and for incorporation into multi-stage booster designs. Embodiments have footprint advantages over "external" devices and can be made to have all the parts captivated (i.e. unable to find their way into the swept volume).

It will be appreciated that some pumps have large stages that can try to pump more gas than the subsequent stages can handle. In those circumstances a high pressure will build up between the large stage and the next stage. The pressure would cause a very high running power for the machine. The pressure can be relieved in different ways: slow the running speed of the machine, the displacement of the large stage is reduced and its internal leakage relieves the pressure; if the pressure at the outlet stage is going to be above the outlet pressure for the whole pump, the gas can blow-off into the exhaust; if the pressure is not going to be that high, or it is undesirable (for other reasons) to connect the outlet of the large stage to the exhaust of the whole pump, then the gas can be blown-off back to the inlet of the stage. The first and last cases are similar in that the relative size of the back-leakage and pump displacement is altered; in the first case, the leakage remains constant and the displacement reduces; in the last case, the leakage increases and the displacement is constant.

In embodiments, the relief valve is located within the separator isolating one stage from the next, and the gas path is through passages in the separator. The most significant advantage is generally the reduction in footprint. Other approaches often involve passages around the outside of the swept volume, obviously necessitating an increase in the exterior dimensions of the pump. In embodiments, the valve could be a cartridge-type component inserted into a cavity in the separator. A valve in the separator can be particularly advantageous when the inter-stage plate is a separate component from the rest of the body forming the stator; in that case the valve can be built in place prior to assembling the separator and the rest of the stator and its components effectively captured, unable to be released into the rest of the pump mechanism.

Accordingly, it can be seen that embodiments provide a two-stage booster clamshell coupling (transfer stage/transfer port). Both the first and second stage booster rotors run in conventionally-machined one-piece stators. The transfer port to take gas from the first stage to the second stage is of a clamshell design consisting of two halves split along the axis of both rotors.

Embodiments recognize that conventional booster stators are of a one-piece design. These are easy to machine and very strong in the event of a rotor failure. However, embodiments also recognize that with a two-stage booster using three separate stator components (a first stage stator, a one-piece transfer stage and a second stage stator), the second stage booster rotors would have to be separate components in order to assemble the pump.

Embodiments also recognize that if a one-piece rotor was used, then top and bottom clamshell stators could house first and second stage rotors and form the transfer stage. However, these two components would have to be designed to be very stiff to avoid distortion during machining and assembly. They would also be relatively difficult to machine due to their size. Embodiments enable the use of one-piece rotors and easily machined components. Both the first and second stage booster rotors run in conventionally-machined one-piece stators. The transfer stage takes gas from the first stage exhaust outlet to the second stage inlet and is of a clamshell design consisting of two halves split along the axis of both rotors.

Embodiments maintain the easy manufacture and high strength of one-piece stators, but make use of a clamshell for the transfer stage. This enables assembly of a one-piece rotor design for a two-stage booster. Embodiments provide multistage pumps, particularly those of roots designs. By using a clamshell transfer stage and one-piece through-bore stators, tighter tolerances can be maintained. Through-bored stators enable the use of rotors without a tip radius that is normally required to clear the radius in the corners of blind stator bores. The improved accuracy of components and tighter tolerance control may enable a five stage roots design, rather than a six or seven stage design that would still be capable of the same low pressures. In one embodiment the clamshell halves of the inter-stage coupling extend to the outside of the pump. In another embodiment the clam shell halves of the interstage coupling are housed in one end of a stator. In particular, the clam shell halves may be housed within one of the two stators, preferably in the shorter second stage stator.

Although illustrative embodiments of the disclosure have been disclosed in detail herein, with reference to the accompanying drawings, it is understood that the disclosure is not limited to the precise embodiment and that various changes and modifications can be effected therein by one skilled in the art without departing from the scope of the disclosure as defined by the appended claims and their equivalents.

REFERENCE SIGNS

| | |
|---|---|
| two-stage booster pump | 10; 10' |
| first stage pump | 20; 20' |
| first stage inlet | 20A; 20A' |
| first stage exhaust | 20B |
| first inner surface | 20C; 20C' |
| second stage pump | 30; 30' |
| second stage inlet | 30A |
| second stage exhaust | 30B; 30B' |
| second inner surface | 30C |
| inter-stage coupling | 40; 40C |
| first portion | 40A; 40A' |
| second portion | 40B; 40B' |
| rotor | 50; 50A; 50B |
| first axial end | 60 |
| second axial end | 70 |
| intermediate axial portion | 80; 80A |
| first rotary vane portion | 90A |
| second rotary vane portion | 90B |
| void | 100; 100' |
| first face | 110A; 110C; 110E; 110G; 110I |
| second face | 110B; 110D; 110F; 110H; 110J; 110J' |
| inlet aperture | 120A; 120A'; 120C |
| outlet aperture | 120B; 120B'; 120D; 120E; 120F; 120G |
| gallery | 130; 130' |
| transfer conduit | 140; 140' |
| recirculation inlet aperture | 150 |
| recirculation outlet aperture | 160A; 160B |
| recirculation conduit | 170A |
| shared conduit | 175; 175C; 175D |

-continued

| REFERENCE SIGNS | |
|---|---|
| valve member | 180A; 180B; 180C; 180D |
| hinge | 182 |
| shared inlet | 185 |
| spring | 190A; 190B, 190C |
| flap arrangement | 195 |
| collar | 200; 200A |
| hemi-cylindrical elements | 210A, 210B |
| screw apertures | 220 |
| indented face | 230 |
| surface | 240 |
| cylindrical segments | 250 |

The invention claimed is:

1. An inter-stage coupling for a multi-stage vacuum pump, comprising:

a first coupling face configured to be received by a first adjacent stage of the multi-stage vacuum pump;

a second coupling face configured to be received by a second adjacent stage of the multi-stage vacuum pump; and a recirculator comprising:

a recirculation inlet aperture formed in the first coupling face, a recirculation outlet aperture formed in the first coupling face, wherein:

the recirculation inlet aperture in the first coupling face is located for fluid communication with an exhaust of the first adjacent stage, and the recirculation outlet aperture in the first coupling face is located for fluid communication with an inlet of the first adjacent stage, and a recirculation conduit having a recirculation valve configured to selectively fluidly couple the recirculation inlet aperture with the recirculation outlet aperture, wherein each of the first and second coupling faces comprises a plate configured to seal an end of the respective adjacent stage of the multi-stage vacuum pump, and wherein the recirculation inlet and outlet apertures are formed in the plate of the first coupling face, and wherein the recirculator is housed within the inter-stage coupling between the first coupling face and the second coupling face;

wherein the inter-stage coupling further comprises a cylindrical void which extends through a width of the inter-stage coupling unit for receiving a rotor such that a rotational axis of the rotor extends therethrough.

2. The inter-stage coupling of claim 1, wherein the first coupling face defines an inlet aperture to receive an exhaust from the first adjacent stage and the second coupling face defines an outlet aperture to deliver the exhaust to the second adjacent stage, and wherein the inter-stage coupling defines a transfer conduit configured to fluidly couple the inlet aperture with the outlet aperture.

3. The inter-stage coupling claim 2, wherein the inlet aperture is located fluidly downstream of the first adjacent stage and the outlet aperture located fluidly upstream of the second adjacent stage.

4. The inter-stage coupling of claim 2, wherein the inlet aperture comprises the inlet recirculation aperture and the transfer conduit shares at least a portion of the recirculation conduit.

5. The inter-stage coupling of claim 1, wherein the recirculation valve comprises a pressure-actuated valve actuatable to couple the recirculation inlet aperture with the recirculation outlet aperture in response to a selected pressure differential between the recirculation inlet aperture and the recirculation outlet aperture.

6. The inter-stage coupling of claim 1, wherein the recirculation valve comprises a valve member, displaceable to couple the recirculation inlet aperture with the recirculation outlet aperture in response to a selected pressure differential between the recirculation inlet aperture and the recirculation outlet aperture.

7. The inter-stage coupling of claim 6, wherein the recirculation valve is configured such that the valve member is displaced by translation.

8. The inter-stage coupling of claim 7, wherein the valve member is a piston.

9. The inter-stage coupling of claim 6, wherein the recirculation valve is configured such that the valve member is displaced by rotation.

10. The inter-stage coupling of claim 7, wherein the valve member is a hinged flap.

11. The inter-stage coupling of claim 6, wherein the valve member is one of biased and weighted in a decoupled position and displaceable to a coupled position in response to a selected pressure differential between the recirculation inlet aperture and the recirculation outlet aperture.

12. A multi-stage vacuum pump, comprising:

a first pumping stage;

a second pumping stage; and an inter-stage coupling the first pumping stage with the second pumping stage, wherein the inter-stage coupling comprises:

a first coupling face configured to be received by a first adjacent stage of the multi-stage vacuum pump;

a second coupling face configured to be received by a second adjacent stage of the multi-stage vacuum pump; and a recirculator comprising:

a recirculation inlet aperture formed in the first coupling face, a recirculation outlet aperture formed in the first coupling face, wherein:

the recirculation inlet aperture in the first coupling face is located for fluid communication with an exhaust of the first adjacent stage, and the recirculation outlet aperture in the first coupling face is located for fluid communication with an inlet of the first adjacent stage, and a recirculation conduit having a recirculation valve configured to selectively fluidly couple the recirculation inlet aperture with the recirculation outlet aperture, wherein each of the first and second coupling faces comprises a plate to seal an end of the respective adjacent stage of the multi-stage vacuum pump, and wherein the recirculation inlet and outlet apertures are formed in the plate of the first coupling face, and wherein the recirculator is housed within the inter-stage coupling between the first coupling face and the second coupling face wherein the inter-stage coupling further comprises a cylindrical void which extends through a width of the inter-stage coupling unit for receiving a rotor such that a rotational axis of the rotor extends therethrough.

13. A method, comprising:

coupling a first coupling face of an inter-stage coupling to a first adjacent stage of a multi-stage vacuum pump; and coupling a second coupling face of the inter-stage coupling to a second adjacent stage of the multi-stage vacuum pump;

wherein the inter-stage coupling further comprises a recirculator comprising:

a recirculation inlet aperture formed in the first coupling face, a recirculation outlet aperture formed in the first coupling face, wherein:

the recirculation inlet aperture in the first coupling face is located for fluid communication with an exhaust of the first adjacent stage, and the recirculation outlet aperture in the first coupling face is located for fluid communication with an inlet of the first adjacent stage, and a recirculation conduit having a recirculation valve configured to selectively fluidly couple the recirculation inlet aperture with the recirculation outlet aperture, wherein each of the first and second coupling faces comprises a plate to seal an end of the respective adjacent stage of the multi-stage vacuum pump, and wherein the recirculation inlet and outlet apertures are formed in the plate of the first coupling face, and wherein the recirculator is housed within the inter-stage coupling between the first coupling face and the second coupling face wherein the inter-stage coupling further comprises a cylindrical void which extends through a width of the inter-stage coupling unit for receiving a rotor such that a rotational axis of the rotor extends therethrough.

* * * * *